US008313215B1

(12) United States Patent
Wawak-Umscheid et al.

(10) Patent No.: US 8,313,215 B1
(45) Date of Patent: Nov. 20, 2012

(54) ROOF LINE LIGHT HOLDER

(76) Inventors: Trudy K. Wawak-Umscheid, Wichita, KS (US); Roger W. Umscheid, Wichita, KS (US)

( * ) Notice: Subject to any disclaimer, the term of this patent is extended or adjusted under 35 U.S.C. 154(b) by 318 days.

(21) Appl. No.: 12/707,009

(22) Filed: Feb. 17, 2010

(51) Int. Cl.
*F21S 4/00* (2006.01)

(52) U.S. Cl. ..... 362/249.01; 362/389; 362/432

(58) Field of Classification Search ..... 362/249.01, 362/249.02, 249.03, 249.04, 249.11, 389, 362/432, 237
See application file for complete search history.

(56) References Cited

U.S. PATENT DOCUMENTS 2,599,303 A * 6/1952 Ward ..... 248/229.26
3,992,758 A * 11/1976 Noda ..... 24/515
4,851,977 A 7/1989 Gary
5,056,747 A * 10/1991 Kireta ..... 248/231.81
5,496,005 A * 3/1996 Dieringer ..... 248/74.2
5,921,511 A * 7/1999 LaPointe ..... 248/73
6,663,069 B1 * 12/2003 Norberg ..... 248/316.7
7,234,671 B2 * 6/2007 Avinger ..... 248/215
2003/0066938 A1 4/2003 Zimmerman
2010/0118554 A1 * 5/2010 Kraus et al. ..... 362/396

* cited by examiner

*Primary Examiner* — Julie Shallenberger
(74) *Attorney, Agent, or Firm* — Kenneth H. Jack; Davis & Jack, L.L.C.

(57) ABSTRACT

A light holder including a suspension tie; a wire cradle attached to the suspension tie; a friction arm attached to the suspension tie; a matrix of knurls extending from the friction arm; and a matrix of concavities aligned with and underlying the matrix of knurls; each knurl among the matrix of knurls having a rhombus shaped periphery and each concavity among the matrix of concavities having a rhombus shaped periphery; each of the rhombus shaped peripheries of the matrices of knurls and concavities having a longitudinal vertex and an oppositely longitudinal vertex, each vertex being acutely angled; the matrices of knurls and concavities corrugating the friction arm and defining an overlying channel grid and an underlying ridge grid.

12 Claims, 6 Drawing Sheets

ROOF LINE LIGHT HOLDER

FIELD OF THE INVENTION

This invention is related to hooks, brackets and clips which are adapted for mounting and holding decorative holiday electrical string lighting, such as electrical Christmas lights, at and along the roof lines of residential and commercial buildings.

More particularly, the instant invention is related to such hooks, brackets and clips which include specialized surface features adapted to enhance their durability and usability.

BACKGROUND OF THE INVENTION

During winter holiday seasons, strings of decorative electrical lights are traditionally mounted and hung along the eves of residential and commercial buildings. In order to facilitate such traditional practice, shingle tab hooks and gutter hooks are known to be utilized. Such tabs and hooks commonly present a longitudinally extending wire hooking structure, and such tabs and hooks are typically composed of flexible plastic.

Such known shingle tab hooks and gutter hooks often undesirably fail to present a surface texture which sufficiently frictionally grips the undersurface of a roof edge shingle or the outer edge of a rain gutter upon which the hook is to be installed. Also, such shingle tab and gutter hooks often undesirably fail to include structural members which lend sufficient structural rigidity to the hook. Another common undesirable attribute of such commonly known shingle tab and gutter hooks is their tendency to weather and degrade over time, making them unsuitable for permanent installation for annual light hanging use.

The instant inventive roof line light holder solves or ameliorates the above noted problems, defects, and deficiencies of commonly known shingle tabs and gutter hooks by configuring a preferably malleable sheet metal holiday light holder to present and include matrices of aligned knurls and concavities which channel and ridge opposing surfaces of the holder, corrugating arm, tie, and cradle components of the holder for durability and enhancing the frictional characteristic of those components' surfaces.

BRIEF SUMMARY OF THE INVENTION

A first structural component of the instant inventive roof line light holder comprises a suspension tie having upper and lower ends. The suspension tie (along with all other structural components discussed and described below) is preferably composed of malleable metal, preferably aluminum. Suitably, the malleable sheet metal utilized may comprise galvanized sheet steel or tin. Also suitably, though with lesser desirability, the metal may comprise ungalvanized sheet steel, copper, or brass. In a preferred embodiment the suspension tie component has a lateral width between ⅜" and 1", a sheet metal thickness between 1/16" and 3/16", and has a vertical length between ½" and 1½".

A further structural component of the instant inventive light holder comprises a wire cradle which is fixedly attached to or wholly formed with the lower end of the suspension tie component. In the preferred embodiment, a wholly formed connection is utilized, the wire cradle having a lateral extension which is coextensive with the suspension tie's lateral width. Preferably the wire cradle is configured to extend longitudinally from the suspension tie, to have an arcuately curved floor, and to open upwardly for nesting receipt of laterally extending electrical holiday light wires.

A further structural component of the instant inventive light holder comprises a friction arm which has upper and lower surfaces and has longitudinal and oppositely longitudinal ends. The longitudinal end of the friction arm is fixedly attached to or is wholly formed with the upper end of the suspension tie. In a preferred embodiment, such attachment comprises a whole formation and is configured as a longitudinally and downwardly curving transition, between 60° and 90°. Preferably the friction arm component has a lateral dimension which is coextensive with that of the suspension tie, and has a matching sheet metal thickness. In a preferred embodiment, the friction arm has a longitudinal dimension between 2½" and 4½", such dimension facilitating frictional gripping of the arm between layered roof shingles. Alternatively, the friction arm may be substantially shortened and configured as a hook for engaging and mounting upon an outer edge of a roof line gutter.

A further structural component of the instant inventive roof line light holder comprises a matrix of knurls which extends from the friction arm's upper or lower surface. Preferably, such matrix of knurls is continuous over all sections of the holder, further extending over the holder's preferred curved transition, then downwardly over and along the suspension tie, and then along and arcuately over the wire cradle.

A preferred further structural component of the inventive holder comprises a matrix of concavities which underlies and closely aligns with the matrix of knurls. Where the matrix of knurls is configured to extend upwardly from the upper face of the friction arm, then longitudinally from the longitudinal face of the suspension tie, and then inwardly from the arcuate inner face of the wire cradle, the concavities of the underlying concavity matrix preferably oppositely and correspondingly extend downwardly from the lower face of the friction arm, oppositely longitudinally from the oppositely longitudinal face of the suspension tie, and outwardly from the arcuate outer surfaces of the wire cradle. Such orientations of the matrices of knurls and concavities may suitably be reversed.

In the preferred embodiment of the instant invention, each knurl and concavity among the matrices of knurls and concavities is diamond or rhombus shaped. The knurl and concavity matrices are preferably die press rolled or press stamped to create interstitial corrugating grids of ridges and underlying channels, such ridges and channels peripherally outlining and defining the knurl and concavity matrices. Such preferred configurations of machine pressed knurl and concavity matrices and the resultant ridge and channel grids advantageously dually function to enhance the frictional characteristics of the surfaces of the light holder and, through the ridge and channels' sheet metal corrugating effect, enhance the structural rigidity of the holder.

The preferred rhombus or diamond shaped geometry of the knurls and concavities advantageously, upon a preferred longitudinal/lateral alignment of their diagonals, extends the corrugating channels and ridges diagonally with respect to the holder's preferably parallel side edges. Such diagonal orientations of the press formed ridges and channels beneficially resists any upward or downward buckling of the friction arm upon installation between shingles or in hooking engagement with a gutter edge. Such diagonal orientation further advantageously enhances the rigidity to the holder's wire cradle section, preventing the cradle from buckling or deforming upon manual installation of the holder, and allowing the cradle to support heavy wires and lights.

In order to further enhance the holder's resistance to buckling or deformation during installation or light holding use, the vertices at the longitudinal and oppositely longitudinal ends of friction arm's preferred rhombus shaped knurls and concavities are preferably acutely angled, their obtusely angled vertices being positioned laterally. Such arrangement of rhombus vertices advantageously longitudinally biases the extensions of the corrugating and structurally reinforcing channels and ridges, enhancing structural stiffness along that dimension in the longitudinal direction.

Accordingly, objects of the present invention include the provision of a roof line light holder which incorporates structures and components as described above, and which arranges those structures and components in relation to each other in manners described above for the achievement of benefits and advantages during installation and use, as described above. Other and further objects, benefits and advantages will become know to those skilled in the art upon review of the detailed description which follows, and upon review of the appended drawings.

BRIEF DESCRIPTION OF THE DRAWINGS

Drawing

Drawing

Drawing

Drawing

Figure 2:
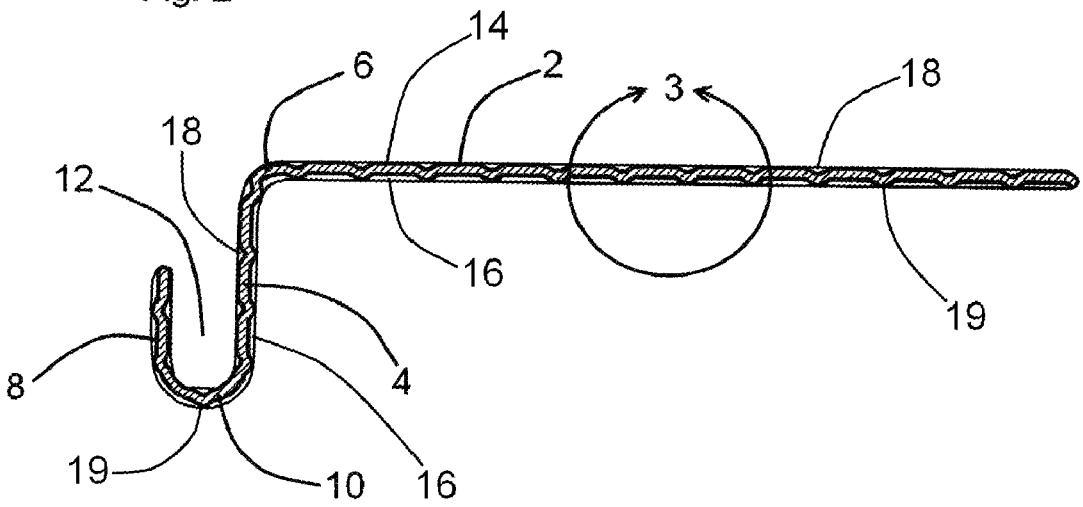
FIG. 2 is a sectional view, as indicated in FIG. 1.
Figure 3:
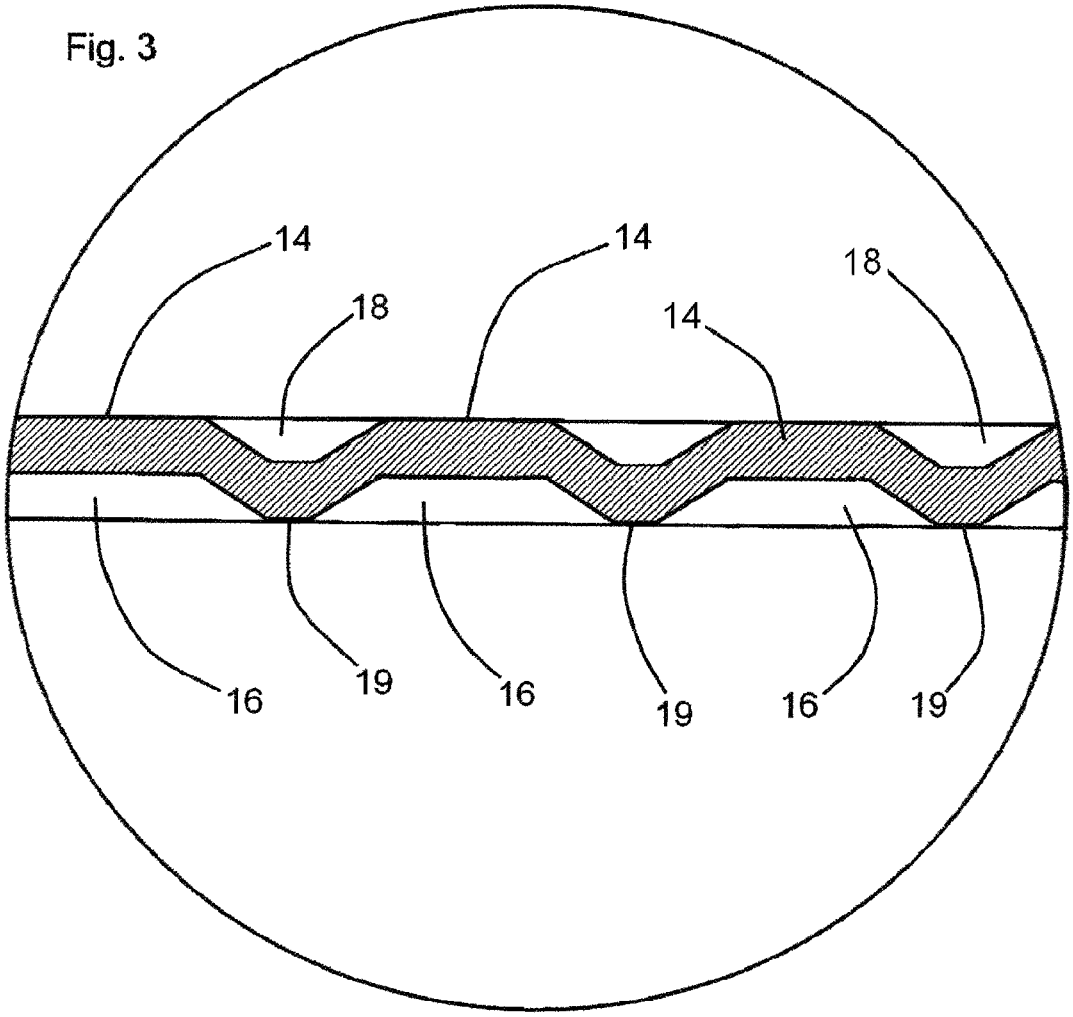
FIG. 3 is a partial magnified view, as indicated in FIG. 2.
Figure 4:
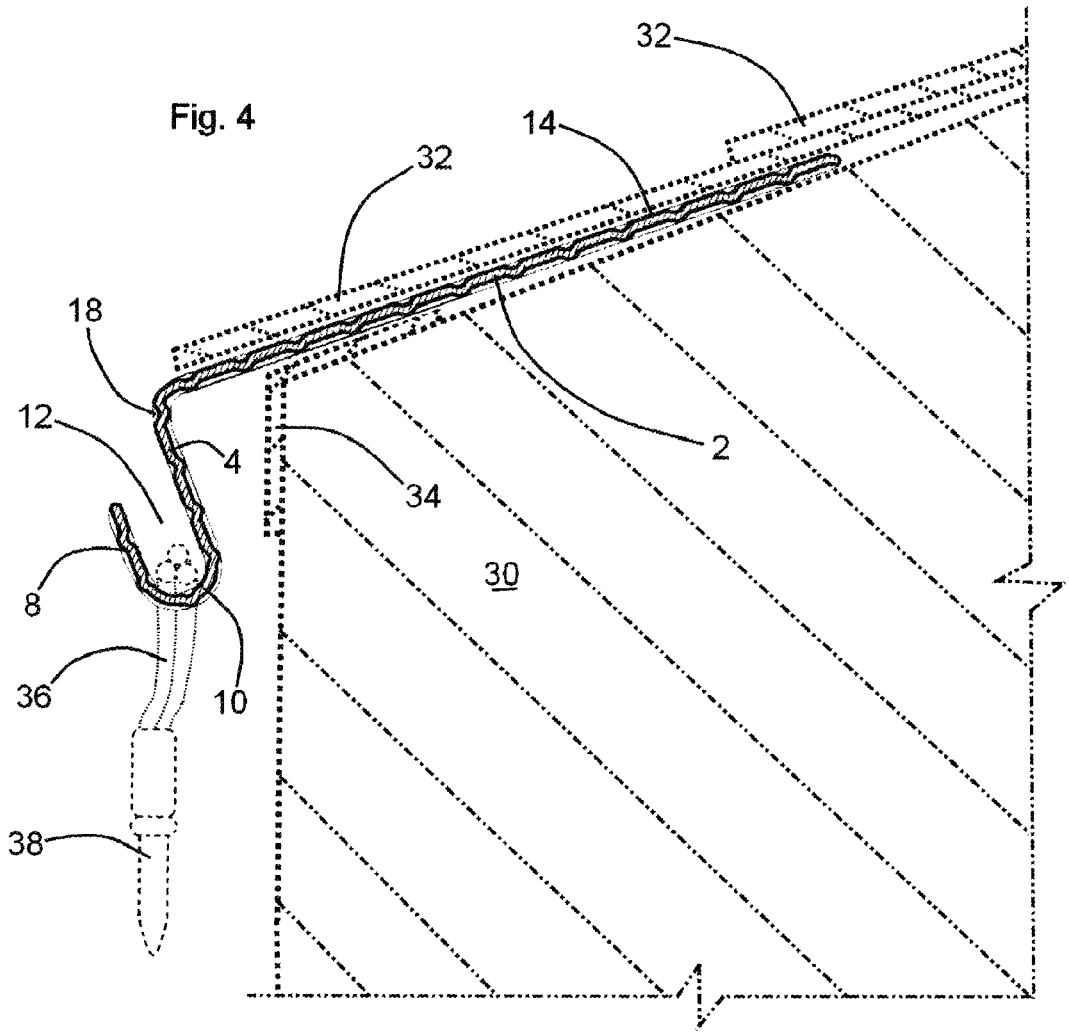

Drawing FIG. 4 re-depicts FIG. 2, the view additionally showing in broken lines an exemplary installation and use of the light holder in association with roof line shingles.

Figure 5:
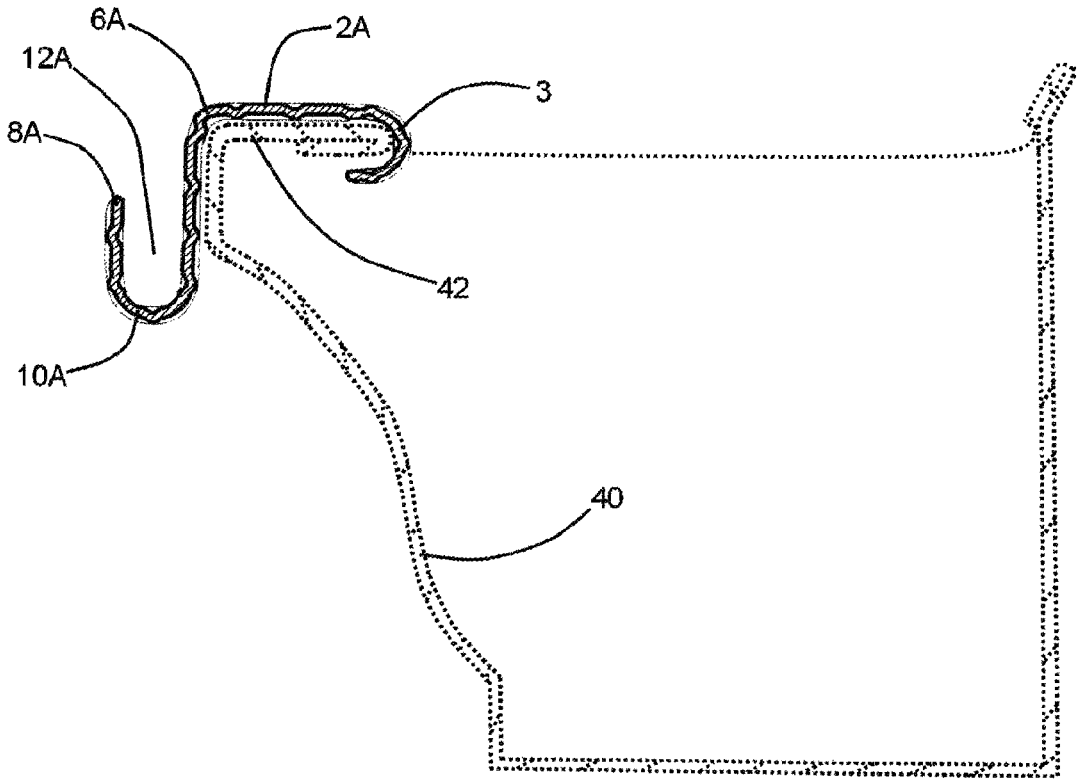

Drawing FIG. 5 presents an alternative gutter engaging configuration of the instant inventive light holder, the view additionally showing in broken lines an exemplary installation and use of the alternative light holder upon a roof line rain gutter.

DETAILED DESCRIPTION OF A PREFERRED EMBODIMENT

Figure 1:
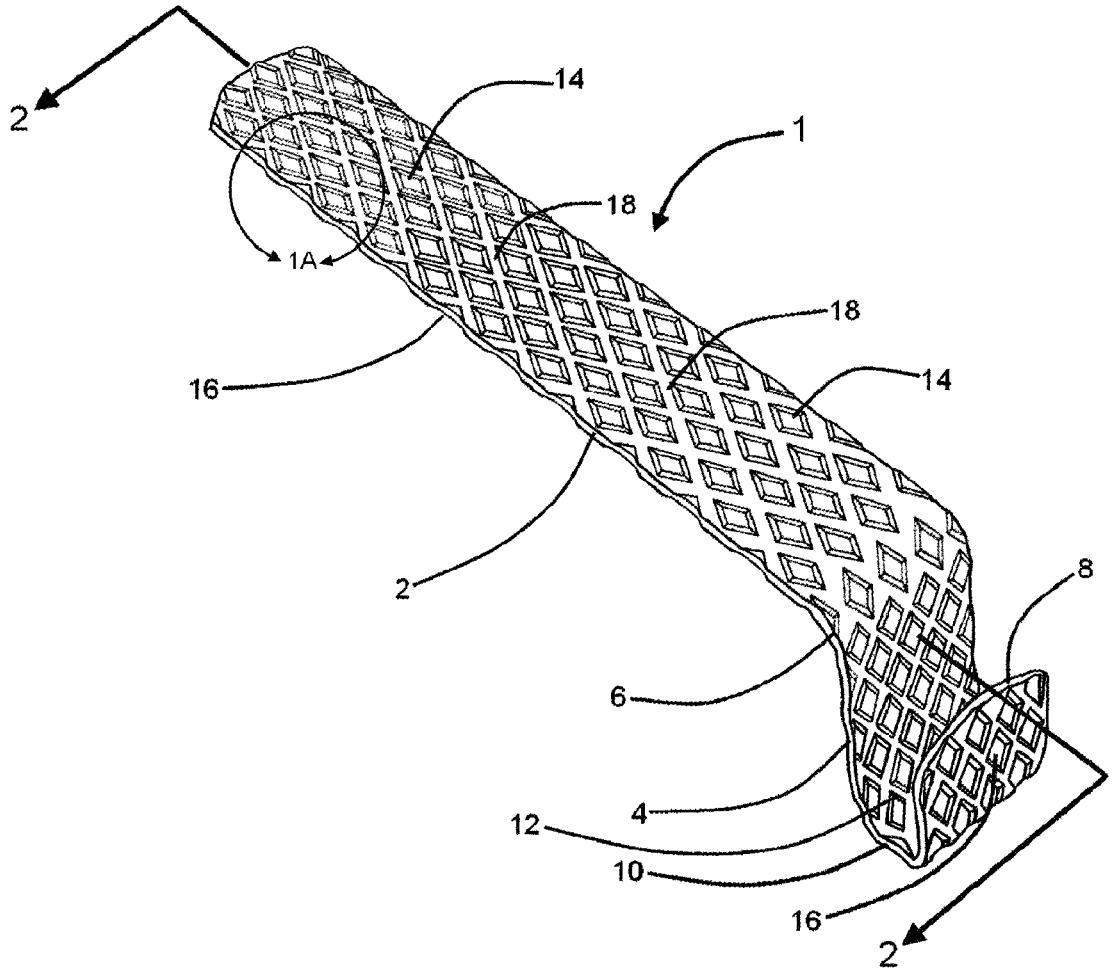
FIG. 1 is a perspective view of a preferred embodiment of the instant inventive roof line light holder.

Referring now to the drawings, and in particular to Drawing FIG. 1, a preferred embodiment of the instant inventive roof line light holder is referred to generally by Reference Arrow 1. The roof line light holder 1 has a suspension tie section 4, a friction arm section 2, and a wire cradle 8,10. Preferably, the upper end of the suspension tie section 4 is attached by whole or continuous formation to the forward or longitudinal end of the friction arm 2, such connection preferably being configured as a downwardly curving transition section 6. The wire cradle section 8,10 is preferably similarly wholly formed with the lower end of the suspension tie 4, the wire cradle 8,10 forming and defining an upwardly opening wire receiving and retaining space 12.

Figure 1A:
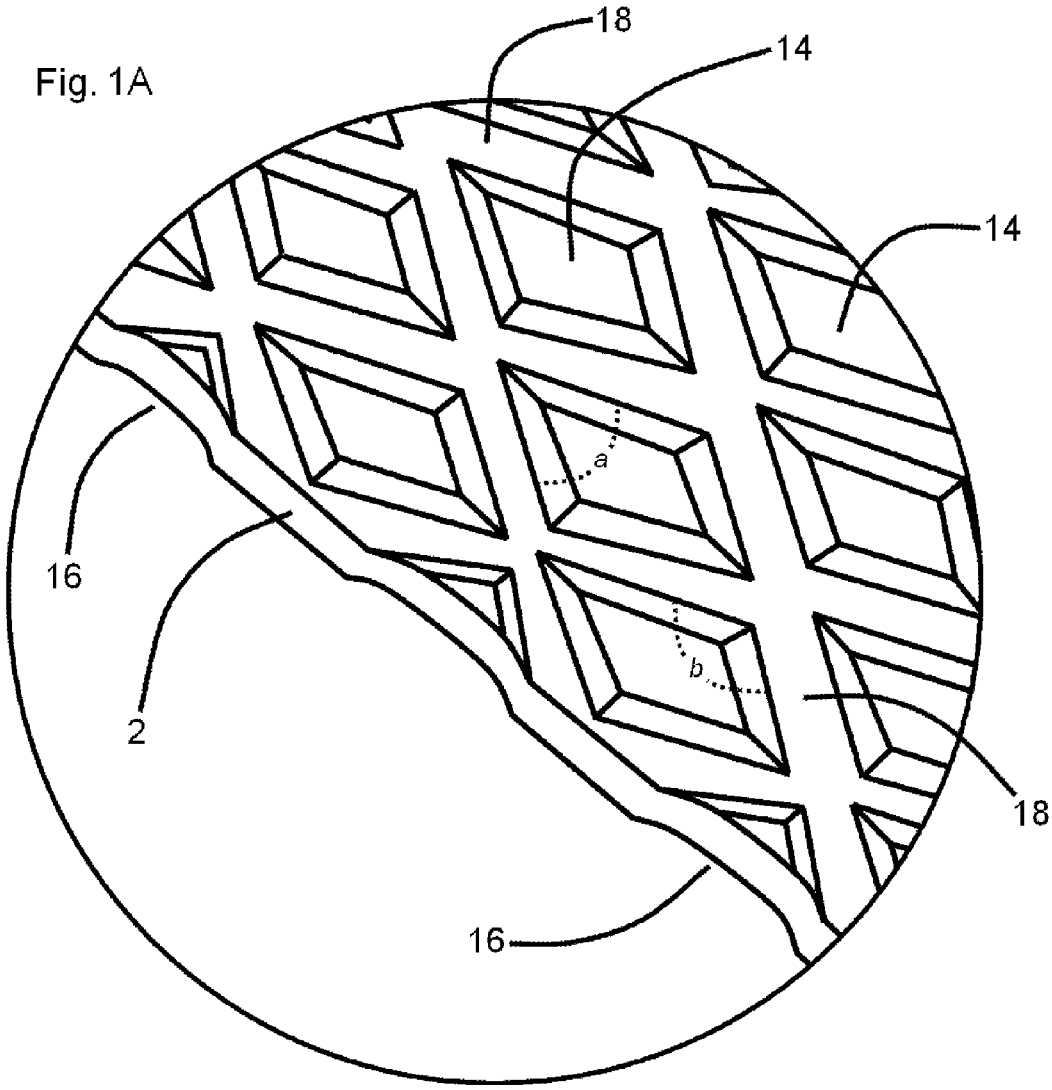
FIG. 1A is a magnified view of a portion of FIG. 1, as indicated in FIG. 1.

Referring simultaneously to FIGS. 1 and 1A, a multiplicity of knurls 14 preferably extend from the friction arm 2. Such multiplicity of knurls 14 preferably further includes knurls extending from the transition section 6, from the suspension tie 4, and from the wire cradle 8,10. The knurls 14 preferably form a regular or regimented matrix which extends over all surfaces of the light holder 1 other than its preferably parallel edge surfaces, such knurl matrix 14 preferably being matched by an aligned and underlying matrix of concavities 16.

Referring to FIGS. 1-4, each of the knurls 14 and each of the concavities 16 preferably has a rhombus or diamond shaped periphery so that the matrices of knurls 14 and concavities 16 forms and defines corrugating grids of channels 18 and ridges 19. The long diagonals of the rhombus shaped knurls 14 and concavities 16 preferably are aligned longitudinally, or with their acutely angled vertices a at the rhombuses' longitudinal and oppositely longitudinal ends, the obtusely angled vertices b being at the lateral diagonals. The longitudinal positioning of the rhombuses' acute vertices a assures that the corrugating and structurally stiffening effect of the ridges 19 and channels 18 primarily extends at angles with respect to the side edges which are biased longitudinally. Accordingly, the matrices of knurls and concavities primarily stiffens the structures in the longitudinal direction. Such matrices of knurls 14 and concavities 16 advantageously dually function for enhancing the frictional characteristics of surfaces of the light holder 1 and for enhancing the structural rigidity of the holder's friction arm 2, suspension tie 4, and wire cradle 8,10 components.

Referring further to FIGS. 1-4, the light holder 1 preferably comprises aluminum sheet metal which is stamped or roller press formed to include the diamond or rhombus ridge and channel pattern, as depicted.

In use of the instant inventive light holder, referring simultaneously to FIGS. 1-5, a user may initially grasp the light holder 1 at its longitudinal end and may move the light holder 1 toward a roof line 30 of a house. Such motion is preferably directed to cause the oppositely longitudinal end of the light holder's friction arm 2 to approach and contact the downslope juncture of the roof line 30 at a seam between laterally extending roof edge flashing 34 and shingles 32. Thereafter, such user may oppositely longitudinally drive and extend the friction arm 2 between shingle 32 and flashing 34 until the friction arm 2 becomes positioned in relation to those structures, substantially as depicted in FIG. 4. During such driving and inserting process, the matrices of knurls 14 and concavities 16 in combination with their defining grids of channels 18 and ridges 19, serve to simultaneously prevent any upward or downward bowing or buckling of the friction arm 2 and prevent any deformation or bending collapse of the wire cradle 8,10.

Following such insertion of the light holder 1, the matrix of knurls 14 in combination with the underlying defined grid of ridges 19, advantageously serves to enhance frictional contact between the light holder 1, the shingle 32, the flashing 34, and the roof line 30.

Thereafter, referring further to FIGS. 1-4, the user may laterally extend and string wires 36 of decorative holiday lights 38 across and over the wire cradle 8,10, such wires 36 being nestingly received within and retained within the upwardly opening wire receiving space 12. Upon such installation of holiday light wires 36 and lights 38, the corrugating grids of ridges 14 and channels 18 produced by the press formed matrices of knurls 14 and concavities 16 enhance the stiffness and structural rigidity of the wire cradle 8,10, allowing heavy light strands 36,38 to be thereby retained without any undesirable deformation or deflection.

Referring to FIG. 5, each reference numeral having a suffix "A" is configured substantially identically with similarly numbered structures appearing in FIGS. 1-4. The light holder of FIG. 5 alternatively configures the oppositely longitudinal end of the holder's friction arm section 2A to form a gutter edge engaging hook 3. As a result of such alternative adoption of such gutter engaging configuration, the instant inventive light holder may be advantageously alternatively be mounted upon and attached to an outer lip 42 of a roof line gutter 40.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

The invention claimed is:

1. A light holder comprising:

(a) a suspension tie having upper and lower ends;

(b) a wire cradle fixedly attached to or formed wholly with the suspension tie's lower end;

(c) a friction arm having upper and lower surfaces, and having longitudinal and oppositely longitudinal ends, the friction arm's longitudinal end being fixedly attached to or formed wholly with the suspension tie's upper end;

(d) a matrix of knurls, each knurl among the matrix of knurls extending upwardly from the friction arm's upper surface or extending downwardly from the friction arm's lower surface; and (e) a matrix of concavities underlying the matrix of knurls; the friction arm's fixed attachment or whole formation comprising a curved transition, and the matrices of knurls and concavities extending over the curved transition, the suspension tie, and the wire cradle; each knurl among the matrix of knurls having a rhombus shaped periphery and wherein each concavity among the matrix of concavities has a rhombus shaped periphery.

2. The light holder of claim 1 wherein each of the rhombus shaped peripheries of the matrices of knurls and concavities has a longitudinal vertex and an oppositely longitudinal vertex.

3. The light holder of claim 2 wherein each of the longitudinal and oppositely longitudinal vertices of the rhombus shaped peripheries are acutely angled.

4. A light holder comprising:

(a) a suspension tie having upper and lower ends;

(b) a wire cradle fixedly attached to or formed wholly with the suspension tie's lower end;

(c) a friction arm having upper and lower surfaces, and having longitudinal and oppositely longitudinal ends, the friction arm's longitudinal end being fixedly attached to or formed wholly with the suspension tie's upper end; and (d) a matrix of knurls, each knurl among the matrix of knurls extending upwardly from the friction arm's upper surface or extending downwardly from the friction arm's lower surface; and further comprising a matrix of concavities underlying the matrix of knurls; the friction arm's fixed attachment or whole formation comprising a curved transition, and the matrices of knurls and concavities extending over the curved transition, over the suspension tie, and over the wire cradle, the matrices of knurls and concavities corrugating the friction arm.

5. The light holder of claim 4 wherein the matrices of knurls and concavities further corrugate the curved transition.

6. The light holder of claim 5 wherein the matrices of knurls and concavities further corrugate the suspension tie.

7. The light holder of claim 5 wherein the matrices of knurls and ridges further corrugate the wire cradle.

8. The light holder of claim 7 wherein the corrugations of the friction arm, the curved transition, the suspension tie, and the wire cradle comprise a channel grid and a ridge grid, the ridge grid underlying the channel grid.

9. The light holder of claim 8 wherein the friction arm, the curved transition, the suspension tie, and the wire cradle have substantially parallel side edges, and wherein the channel and ridge grid's channels and ridges extend angularly with respect to said side edges.

10. The light holder of claim 1 wherein the friction arm's oppositely longitudinal end is configured to present a gutter edge hook.

11. The light holder of claim 1 wherein the friction arm, the curved transition, the suspension tie, and the wire cradle are composed of malleable sheet metal.

12. The light holder of claim 11 wherein each knurl among the matrix of knurls comprises a press formed protuberance.

* * * * *